US005215704A

United States Patent [19]

Hirota

[11] Patent Number: 5,215,704

[45] Date of Patent: Jun. 1, 1993

[54] METHOD AND APPARATUS FOR IN SITU TESTING OF HEAT EXCHANGERS

[75] Inventor: Norris S. Hirota, Milpitas, Calif.

[73] Assignee: Electric Power Research Institute, Palo Alto, Calif.

[21] Appl. No.: 719,725

[22] Filed: Jun. 24, 1991

[51] Int. Cl.[5] ..... G21C 17/00

[52] U.S. Cl. ..... 376/245; 376/246; 376/247; 374/39; 374/40; 374/41

[58] Field of Search ..... 376/245, 246, 247, 450; 374/39, 40, 41

[56] References Cited

U.S. PATENT DOCUMENTS

| | | | |
|---|---|---|---|
| Re. 33,346 | 9/1990 | Knudsen et al. | 73/61.2 |
| 2,252,367 | 8/1941 | Germer | 73/196 |
| 2,931,222 | 4/1960 | Nöldge et al. | 73/193 |
| 3,016,738 | 1/1962 | Eule | 73/112 |
| 3,065,162 | 11/1962 | Hub | 204/193.2 |
| 3,918,300 | 11/1975 | Weisstuch et al. | 73/112 |
| 4,000,037 | 12/1976 | Nusbaum et al. | 176/19 R |
| 4,044,605 | 8/1977 | Bratthäll | 73/61.2 |
| 4,186,563 | 2/1980 | Schulze, Sr. | 62/126 |
| 4,222,436 | 9/1980 | Pravda | 165/105 |
| 4,244,216 | 1/1981 | Dukelow | 73/190 H |
| 4,485,449 | 11/1984 | Knauss | 364/510 |
| 4,595,297 | 6/1986 | Liu et al. | 374/29 |
| 4,629,115 | 12/1986 | Lampert et al. | 236/36 |
| 4,729,667 | 3/1988 | Blangetti et al. | 374/43 |
| 4,753,770 | 6/1988 | Bogdan et al. | 376/246 |
| 4,762,168 | 8/1988 | Kawabe et al. | 165/11.1 |
| 4,766,553 | 8/1988 | Kaya et al. | 364/506 |
| 4,862,698 | 9/1989 | Morgan et al. | 62/77 |
| 4,910,999 | 3/1990 | Eaton | 73/61.2 |

OTHER PUBLICATIONS

"Tube Cleanliness Determination", Section 5, ANSI/ASME Publication PTC 12.2-1983, pp. 21-29.

*Primary Examiner*—Donald P. Walsh
*Assistant Examiner*—Chrisman D. Carroll
*Attorney, Agent, or Firm*—Skjerven, Morrill, MacPherson, Franklin & Friel

[57] ABSTRACT

Using the method of this invention, the performance of a heat exchanger is determined by measuring the heat transfer capabilities of an individual tube. A relatively small reservoir of service fluid is connected to the inlet and outlet ports of a tube. The reservoir is provided with a heater or chiller and the service fluid is circulated through the tube. When a steady state is reached, the heat transfer characteristics of the tube are measured using known mathematical relationships.

12 Claims, 2 Drawing Sheets

METHOD AND APPARATUS FOR IN SITU TESTING OF HEAT EXCHANGERS

FIELD OF THE INVENTION

This invention relates to a method and apparatus for testing the heat transfer rate of a heat exchanger in situ and, in particular, to a method and apparatus for testing the heat transfer rate of a heat exchanger located in a nuclear or other power plant.

BACKGROUND OF THE INVENTION

One type of heat exchanger consists of a number of tubes through which a service fluid (normally a coolant) circulates and on the outside of which a process fluid (the fluid being cooled) flows. When both the service fluid and the process fluid are water, the heat exchanger is referred to as a water-to-water heat exchanger. In another common type of heat exchanger, the process fluid flows through a number of tubes, and a gas (frequently air) is circulated around the pipes, which often have fins attached to them to improve their heat transfer capabilities. When the process fluid is water, this type of heat exchanger is referred to as an air-to-water heat exchanger. Normally the process fluid is cooled in a heat exchanger, but there is no reason in principle that a heat exchanger cannot be used to heat a process fluid.

When a liquid such as water is used as the service fluid or the process fluid, the surfaces of the tubes that are in contact with the liquid may become fouled and the heat transfer efficiency of the device will therefore be impaired. (Fouling contamination is not usually a problem where only air contacts the tubes.) Fouling can take several forms: (i) particulate matter in the liquid may settle on or otherwise become attached to the surface of the tubes; (ii) substances dissolved in the fluid (e.g., calcium carbonate dissolved in water) may come out of solution and precipitate onto the heat transfer surfaces; (iii) the fluid may react with the heat transfer surface, forming a layer (e.g., corrosion on carbon steel) which acts as a barrier to the flow of heat; (iv) macroorganisms (e.g., Asiatic clams) or microorganisms (e.g., bacteria) may become attached to the tubes and thereby impede the heat flow between the process fluid and the service fluid. Microorganic fouling is a particular problem where the ultimate heat sink is an open body of water (an ocean, river or pond), and it is often more difficult to predict than the other kinds of barriers described above. Moreover, a layer of microorganisms may send out a layer of hairs or other projections to feed on nutrients in the water. These projections can impede the flow of the service fluid, producing a layer of relatively still water which acts as a further barrier to heat flow.

A nuclear power plant contains a number of heat exchangers which are designed to remove heat that may be generated during an emergency. Unless the plant actually experiences an emergency, these heat exchangers remain unused, and whether their heat removal capabilities have become impaired as a result of fouling is unknown. Recognizing the risks of this situation, the U.S. Nuclear Regulatory Commission on Jul. 18, 1989 issued Generic Letter 89-13, which requires that operators of nuclear power plants adopt a program to verify the heat transfer capability of all safety-related heat exchangers cooled by service water.

Because of the large volume of service and process water which flows through the heat exchangers used in nuclear power plants, testing the efficiency of such a heat exchanger presents problems. Whichever fluid (i.e., service or process) is to be heated (or chilled) to conduct the test, a temperature differential of several degrees (for example, 2 or 3 degrees F.) at most can be obtained. This is far less than the temperature differential that would occur during an actual emergency, and thus the behavior of the heat exchanger during an emergency can be predicted only by extrapolating the results of the test to a much larger temperature differential. Therefore, extremely accurate (and hence expensive) instruments must be used to avoid any errors of measurement that would be unduly magnified in the extrapolation process.

The efficiency of a heat exchanger can also be gauged relatively inexpensively by measuring the pressure drop between the inlet and outlet of the service water. The pressure drop is related to flow restriction which in turn reflects the amount of fouling, and for a particular exchanger and type of fouling this information can be used to estimate the heat transferability of the exchanger. However, this test is not very useful unless the operator develops a correlation between the pressure drop and the heat transfer rate of the particular exchanger involved. This in turn requires an accurate means of directly determining the heat transfer rate of the exchanger.

The difficulty of measuring the heat transfer performance of their heat exchangers has led some operators to clean them periodically, whether or not their performance is known to be impaired. While this is one solution to the problem, unnecessary cleaning may shorten the service life of a heat exchanger. Ideally, a heat exchanger should be cleaned only as often as is necessary to assure that its heat transfer capabilities are satisfactory.

SUMMARY OF THE INVENTION

Using the method of this invention, the performance of a heat exchanger is determined by measuring the heat transfer capabilities of an individual tube. A relatively small reservoir of service fluid is connected to the inlet and outlet ports of a tube. The reservoir is provided with a heater or chiller and the service fluid is circulated through the tube. When a steady state is reached, the heat transfer characteristics of the tube (including the fouling resistance) are measured using known mathematical relationships.

By testing an individual tube, a relatively large differential between the temperature of the service fluid at the inlet and outlet of the tube (for example, 10 to 15 degrees F.) can be obtained. The results of this test can be extrapolated to the temperature differentials that would be encountered in an emergency more easily and without the need for unduly expensive instruments.

Apparatus for conducting such a test is also described.

DESCRIPTION OF THE INVENTION

Figure 1:
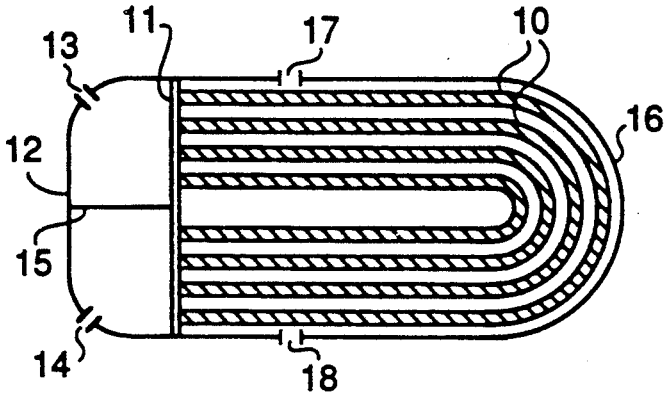
FIG. 1 illustrates a "U-tube" heat exchanger in cross section.

Water-to-water heat exchangers typically are constructed in two forms. In the "U-tube" configuration shown in FIG. 1, a plurality of tubes 10 are formed into the shape of a "U" with their ends fitted into holes in a tube sheet 11. A bonnet 12 having an inlet port 13 and an outlet port 14 for the service fluid is bolted or otherwise secured to the periphery of tube sheet 11, and a divider plate 15 is positioned inside the bonnet to separate the inlet ports and outlet ports of the tubes. A shell 16 having an inlet port 17 and outlet port 18 for the process fluid is also fastened to the periphery of tube sheet 11.

In a "straight-tube" type of heat exchanger (not shown), the tubes are straight and their ends are fitted into two separate tube sheets, each having a bonnet attached at its periphery. The service fluid is admitted into one of the bonnets, flows through the tubes, and exits through an outlet port in the other bonnet. A shell having inlet and outlet ports for the process fluid surrounds the tubes and is attached to the periphery of each tube sheet.

Figure 2:
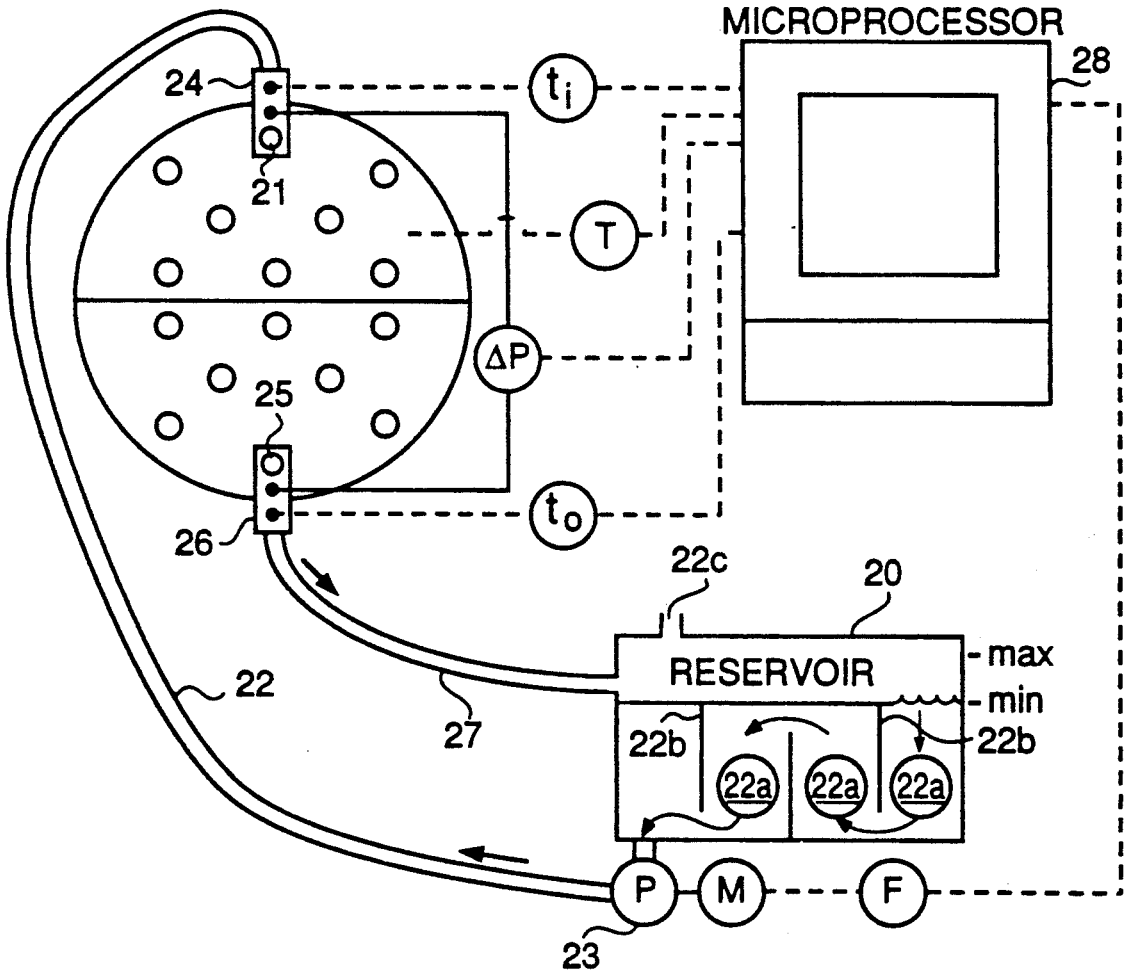
FIG. 2 illustrates schematically a heat exchanger and equipment used in conducting a heat transfer test in accordance with this invention.

FIG. 2 illustrates an end view of the heat exchanger of FIG. 1 with the bonnet removed and shows schematically the fittings and instrumentation necessary to conduct a heat transfer test in accordance with this invention. A water reservoir 20 is connected to an inlet port 21 of a tube in the heat exchanger via an inlet hose 22 and a metered pump 23. An inlet fitting 24 forms the connection between hose 22 and port 21. An outlet port 25 of the same tube is connected to reservoir 20 via an outlet fitting 26 and an outlet hose 27.

Reservoir 20 contains cooling coils 22*a* and baffles 22*b* which assure that the water is mixed and at a uniform temperature before it is returned to hose 22. A vent 22*c* allows the escape of any air that is initially in hoses 22 or 27 or the tube being tested.

A microprocessor 28 is fed signals indicating the temperature ($t_i$) of the water at inlet port 21, the temperature ($t_o$) of the water at the outlet port , the temperature (T) of the process fluid, the pressure differential ($\Delta P$) between the water at inlet port 21 and outlet port 27, and the flow rate provided by pump 23.

Figure 3:
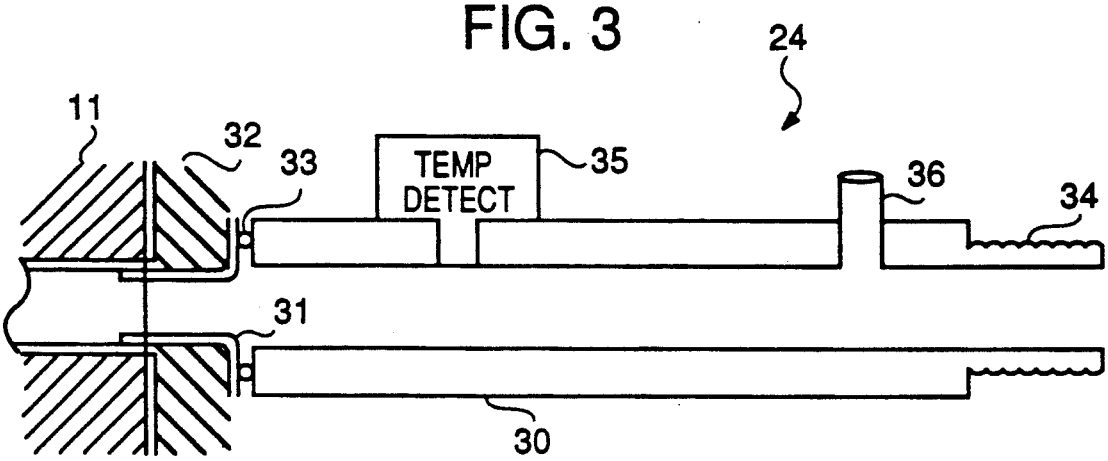
FIG. 3 illustrates in detail the connection to an inlet or outlet of a tube at the tube sheet.

FIG. 3 illustrates inlet fitting 24 in detail. Fitting 24 contains a tubular body 30 attached at one end to a centering guide 31 which is inserted into the tube. A rubber seal 32 provides a leakproof seal between centering guide 31 and tube sheet 11. An 0-ring 33 seals body 30 and centering guide 31. Inlet hose 22 fits over a hose connection 34 at the other end of body 30. Inserted through the wall of body 30 are a temperature detector 35 (e.g., a resistance temperature detector, thermistor or thermocouple) and a pressure detector 36, both of which are connected to microprocessor 28 as shown in FIG. 2.

Outlet fitting 26 is similar in construction to inlet fitting 24.

The heat transfer performance of an individual tube in a heat exchanger is measured by U, which is its actual heat transfer coefficient in operation. Its optimal heat transfer coefficient when it is clean is represented by $U_c$. $r_f$, the fouling resistance of the layer or layers of contamination, is equal to:

$$r_f = 1/U - 1/U_c$$

If there is more than one layer of deposit on the inside and/or outside of the tube, $r_f$ is the summation of the fouling resistance of the layers:

$$r_f = r_1 + r_2 \cdots r_a$$

The actual heat transfer coefficient U is derived by equating (i) the loss of heat from the fluid as it flows through the tube to (ii) the heat flow through the wall of the tube and any deposit layers on the surface of the tube. The loss of heat from the fluid is represented by:

$$Q = mC_p(t_o - t_i) \quad (1)$$

where,

Q is the heat flow in Btu/hr m is the mass flow rate of the fluid in lbs/hr $C_p$ is the specific heat of the fluid at constant pressure in Btu/lbs-° F.

$t_i$ is the temperature at the inlet of the tube $t_o$ is the temperature at the outlet of the tube The heat flow through the tube wall and fouling layers is represented by:

$$Q = UA_0(LMTD) \quad (2)$$

where,

U is the actual heat transfer coefficient of the heat exchanger in Btu/hr-ft$^2$-° F.

$A_o$ is the area of the outside surface of the tube in ft$^2$

LMTD is the log mean temperature difference between the service water in the tube and the process fluid in ° F., which in turn is equal to $$LMTD = \frac{(T - t_i) - (T - t_o)}{\ln \frac{(T - t_i)}{(T - t_o)}}$$

where T is the temperature of the process fluid, which is assumed to be a constant.

Solving equations (1) and (2) for U yields:

$$U = \frac{mC_p(t_o - t_i)}{A(LMTD)}$$

Thus U is expressed in terms of the characteristics of the service water ($C_p$), the dimensions of the tube (A), temperatures of the water and process fluid ($t_o$, $t_i$, T), and the rate of flow of the service water (the mass rate of flow (m) is easily computed from the flow meter on pump 23, e.g., for water, m=496.79 times the flow rate in gals/min). All of these quantities are either known or are obtainable from the meter and detectors associated with the heat exchanger and pump 23. Microprocessor 28 can easily be programmed to provide a continuous indication of U. Alternatively, U can be computed manually.

The arrangement described above contemplates that the service fluid would be chilled in reservoir 20. If reservoir 20 includes a heater instead of a cooler, the same calculations can be performed except that $t_i$ and $t_o$ are reversed in each of the equations.

The number of heat exchanger tubes that need to be tested depends on the statistical distribution of fouling in the individual tubes and is expected to vary between six tubes and 10% of the total number of tubes. It appears that the tubes to be tested should be selected randomly.

Once the heat transfer coefficient U has been determined, it can be compared with $U_c$, the heat transfer coefficient of the heat exchanger in a clean condition, to calculate $r_f$, the fouling resistance. The heat transfer capability of the heat exchanger decreases as the fouling resistance increases.

The value of $U_c$ is can be obtained or derived from the technical specifications and design data for the heat exchanger. If it is not available, one of the tubes can be cleaned and the test can be performed on the clean tube.

The pressure differential between the inlet and outlet ports 13 and 14 of bonnet 12 may be recorded at the time of each test, and a correlation between pressure differential and the heat transfer coefficient of the exchanger can be developed. If the correlation appears reliable, then the pressure differential can be monitored in lieu of future direct measurements of the heat transfer coefficient, saving considerable time and expense.

The method and structure described above can be used both with liquid-to-liquid heat exchangers and liquid-to-gas heat exchangers. If the tubes are finned, the outside area can be determined from the number and geometry of the fins.

The above description is intended to be illustrative and not limiting. Other methods and embodiments will be apparent to those skilled in the art all of which are within the broad principles of this invention.

I claim:

1. A method of determining the extent of fouling in a heat exchanger including a plurality of tubes, the tubes of said heat exchanger being fouled to some degree, said method comprising the steps of:

connecting a test reservoir to an inlet port and an outlet port of one of said tubes, said one of said tubes remaining in place in said heat exchanger;

circulating a service fluid from said test reservoir through said one of said tubes;

altering the heat content of said service fluid in said test reservoir; and detecting (a) the temperature of said service fluid at the respective ends of said tube, (b) the flow rate of said service fluid, and (c) the temperature of a process fluid on the outside of said tube;

using the values of said items (a), (b) and (c) to compute a heat transfer efficiency for said one of said tubes;

using the heat transfer efficiency of said one of said tubes to determine the extent of fouling of the tubes in said heat exchanger.

2. The method of claim 1, said method being used to determine the extent of fouling of a heat exchanger in a nuclear power plant, said heat exchanger being intended to remove heat from said process fluid in the event of an accident in said nuclear power plant, said heat exchanger transferring a substantially lower quantity of heat when said nuclear power plant is in normal operation than said heat exchanger is required to transfer in the event of an accident in said nuclear power plant.

3. The method of claim 1 comprising the step of determining the fouling resistance ($r_f$) of said one of said tubes.

4. A method of determining the extent of fouling of a heat exchanger comprising performing the method of claim 1 on a plurality but substantially less than all of the tubes in a heat exchanger.

5. The method of claim 4 comprising performing the method of claim 1 on at least six tubes but less than 10% of the total number of tubes in said heat exchanger.

6. The method of claim 5 wherein said tubes are selected randomly.

7. A combination in a nuclear power plant, said combination comprising:

a heat exchanger for removing heat from a heated fluid in the event of an accident in said nuclear power plant, said heat exchanger comprising a plurality of tubes, said heat exchanger transferring a substantially lower quantity of heat when said nuclear power plant is in normal operation than said heat exchanger is required to transfer in the event of an accident in said nuclear power plant;

apparatus conducting a test to determine the extent of fouling of said heat exchanger, said apparatus comprising;

a test reservoir for a service fluid and a means for changing the heat content of said service fluid;

means for connecting said test reservoir to the respective ends of at least one but substantially less than all of said tubes;

means for calculating said service fluid through said at least one of said tubes; and means for detecting the temperature of said service fluid at the respective ends of said at least one of said tubes, the flow rate of said service fluid, and the temperature of a process fluid on the outside of said at least one of said tubes.

8. The arrangement of claim 7 comprising a computer, said detection means being connected to said computer.

9. The arrangement of claim 7 wherein said means for exchanging the heat content of said service fluid comprises a heater.

10. The arrangement of claim 7 wherein said means for exchanging the heat content of said service fluid comprises a chiller.

11. The arrangement of claim 7 wherein said service fluid and said process fluid are liquids.

12. The arrangement of claim 7 wherein said apparatus is configured so as to be disconnected from said test exchanger when said test has been completed.

* * * * *